US005440903A

United States Patent [19]

Kropf et al.

[11] Patent Number: 5,440,903

[45] Date of Patent: Aug. 15, 1995

[54] WASHING MACHINE AGITATOR

[75] Inventors: Keith E. Kropf; Richard P. Bergeson, both of Newton; Luann E. Fitzpatrick, Des Moines, all of Iowa

[73] Assignee: Maytag Corporation, Newton, Iowa

[21] Appl. No.: 271,231

[22] Filed: Jul. 6, 1994

Related U.S. Application Data

[63] Continuation of Ser. No. 153,618, Nov. 17, 1993, abandoned.

[51] Int. Cl.[6] ..... D06F 17/10

[52] U.S. Cl. ..... 68/134

[58] Field of Search ..... 68/134; D32/26

[56] References Cited

U.S. PATENT DOCUMENTS

| | | | |
|---|---|---|---|
| D. 300,969 | 5/1989 | Bergeson | D32/26 |
| 1,555,307 | 9/1925 | Moe . | |
| 1,613,318 | 1/1927 | Fedler | 68/134 |
| 1,834,936 | 12/1931 | Bryant . | |
| 2,502,702 | 4/1950 | Castner | 68/134 |
| 2,895,319 | 7/1959 | Rochefort . | |
| 3,022,655 | 2/1962 | Gerhardt et al. | 68/18 F |
| 3,112,632 | 12/1963 | Walton | 68/54 |
| 3,245,235 | 4/1966 | Long | 68/17 A |
| 3,285,040 | 11/1966 | Bochan | 68/134 |
| 3,381,504 | 5/1968 | Smith | 68/134 X |
| 3,592,026 | 7/1971 | Walton | 68/134 |
| 3,648,486 | 3/1972 | Rosinski, Jr. et al. | 68/134 X |
| 3,726,114 | 4/1973 | Ahmad | 68/134 |
| 3,987,652 | 10/1976 | Ruble | 68/134 |
| 4,018,067 | 4/1977 | Vona, Jr. et al. | 68/134 |
| 4,127,015 | 11/1978 | Platt et al. | 68/134 X |
| 4,207,760 | 6/1980 | Bochan | 68/134 X |
| 4,391,107 | 7/1983 | Gibson | 68/134 X |
| 4,402,198 | 9/1983 | Cartier | 68/134 X |
| 4,693,095 | 9/1987 | Burk et al. | 68/134 |

FOREIGN PATENT DOCUMENTS

| | | | |
|---|---|---|---|
| 1259826 | 2/1968 | Germany | 68/134 |
| 129096 | 7/1984 | Japan | 68/134 |
| 206279 | 8/1988 | Japan | 68/134 |

*Primary Examiner*—Philip R. Coe

*Attorney, Agent, or Firm*—Zarley, McKee, Thomte, Voorhees & Sease

[57] ABSTRACT

A washing machine agitator includes a vertical barrel having a tapered skirt connected to the lower end thereof. A plurality of lower vanes are connected to the barrel and extend radially outwardly adjacent the tapered skirt. A splash rib extends circumferentially around the barrel adjacent its upper end. A plurality of triangular vanes are connected to the barrel and extend upwardly to abut against the downwardly presented surface of the splash rib. A number of pairs of rectangular ribs are also attached to the barrel between the triangular vanes and extend upwardly to abut the splash rib.

23 Claims, 3 Drawing Sheets

WASHING MACHINE AGITATOR

This is a continuation of application Ser. No. 08/153,618 filed on Nov. 17, 1993 now abandoned.

BACKGROUND OF THE INVENTION

This invention relates to a washing machine agitator.

Presently known clothes washing machines include a washing basket having a centrally located agitator which rotates about a vertical axis in a reciprocating manner.

Several phenomena occur during the operation of presently known washing machines having reciprocating agitators. One phenomena is referred to as "turnover". This term refers to the motion of the clothing in the clothes washer basket during its operation. The clothes respond to the agitating motion of the agitator by moving from the bottom of the basket up the outer sides of the basket to the top surface of the water in the basket. They then are drawn across the upper portion of the water in the basket radially inwardly toward the central barrel of the agitator. Most prior art agitators have ribs or vanes extending radially outwardly from the barrel. As the vanes reciprocate back and forth they draw the clothing on top of the water radially inwardly and downwardly along the vertical barrel of the agitator. The clothes are drawn to the bottom of the basket and are recycled upwardly at the outer edges of the basket to repeat the cycle. The term "turnover" refers to the ability of the agitator to draw the clothing floating on the top of the water radially inwardly and downwardly so as to turn the clothing over and cause it to move to the bottom of the basket. Turnover is an important feature which facilitates the cleaning of the clothes as they are being agitated.

Another phenomena associated with agitators and clothes washing machines is the term "wetting action" this term refers to the splashing of the water near the top of the barrel of the agitator. The ribs on the barrel generally cause the water to splash upwardly and radially outwardly so that it falls upon the clothing floating at the top of the 0 water surface. This wets the clothing, and causes the clothing to sink below the surface of the water so that it can be drawn radially inwardly to produce appropriate turnover.

Prior agitators such as the one shown in U.S. Pat. No. 4,127,015 have included undulating or serpentine ribs mounted on the outer surface of the agitator and extending to the top of the agitator. These undulating or serpentine ribs provide turnover and wetting action, but are harsh on delicate fabrics, and cause unnecessary wear to such delicate fabrics.

Agitators using straight ribs which are not undulating or serpentine have produced a more gentle washing action, but have heretofore not extended sufficiently high on the barrel of the agitator to create the desired turnover and wetting action when the washing machine is filled to capacity load.

Therefore a primary object of the present invention is the provision of an improved washing machine agitator.

A further object of the present invention is the provision of an agitator which provides improved wetting action, but which minimizes splashing out of the top of the washing machine.

A further object of the present invention is the provision of an improved washing machine agitator which provides a better wetting action near the top of the agitator post when the washing machine is filled to capacity.

A further object of the present invention is the provision of an improved washing machine agitator which improves the turnover of clothes when the washing machine is filled with water and clothes to its capacity.

A further object of the present invention is the provision of an improved agitator which can be molded in a single unitary piece.

A further object of the present invention is the provision of an improved washing machine agitator which is economical to manufacture, durable in use and efficient in operation.

SUMMARY OF THE INVENTION

The foregoing objects may be achieved by a washing machine agitator having a vertical central barrel. An agitator skirt tapers generally downwardly and outwardly from the lower end of the barrel. A splash rib extends circumferentially around the barrel adjacent its upper end and protrudes outwardly from the external surface of the barrel. A plurality of lower vanes are connected to the barrel adjacent its lower end and extend outwardly therefrom adjacent and above the tapered skirt surface. A plurality of upper vanes are connected to the barrel. Each of these upper vanes extend outwardly from the barrel and have an outer edge which commences at the upper end of the vane adjacent the splash rib and extends downwardly and outwardly to terminate in a lower end. The splash rib is located within the washing machine basket at a point located spaced above the maximum level of water within the washer basket. Because the upper ends of the upper vanes abut against the splash rib, they also extend above the maximum level of the water.

The foregoing agitator provides a better wetting action near the top of the agitator post, and this is particularly true when the clothes washer basket is filled to its capacity load. During the reciprocating motion of the agitator, water travels up the ribs and is thrown radially outwardly on to any clothing which is floating on the surface of the water. The horizontal surface of the splash rib prevents the water from splashing upwardly out of the basket, and instead deflects the water radially outwardly away from the agitator post to improve the wetting of clothes floating on the top of the water.

The foregoing agitator also provides improved turnover of clothes, particularly when the clothes washer is filled to its capacity load. The clothes are drawn inwardly by the ribs and vanes which extend up to the splash rib.

DETAILED DESCRIPTION OF THE PREFERRED EMBODIMENT

Figure 1:
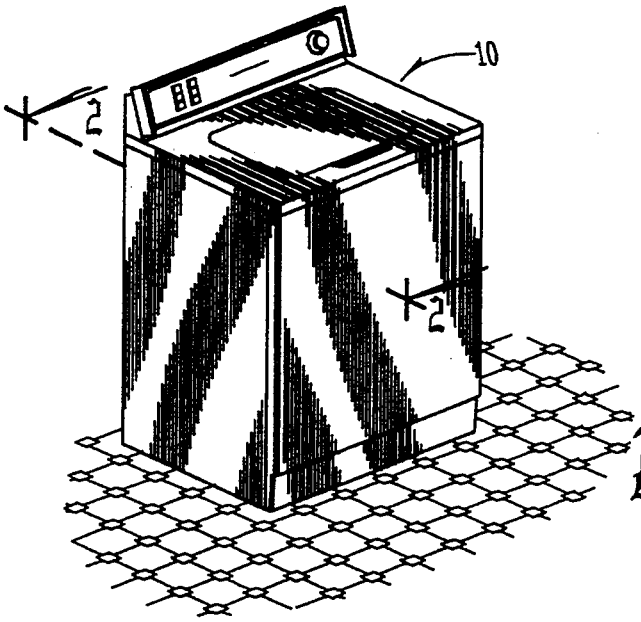
FIG. 1 is a perspective view of a clothes washing machine utilizing the agitator of the present invention.
Figure 2:
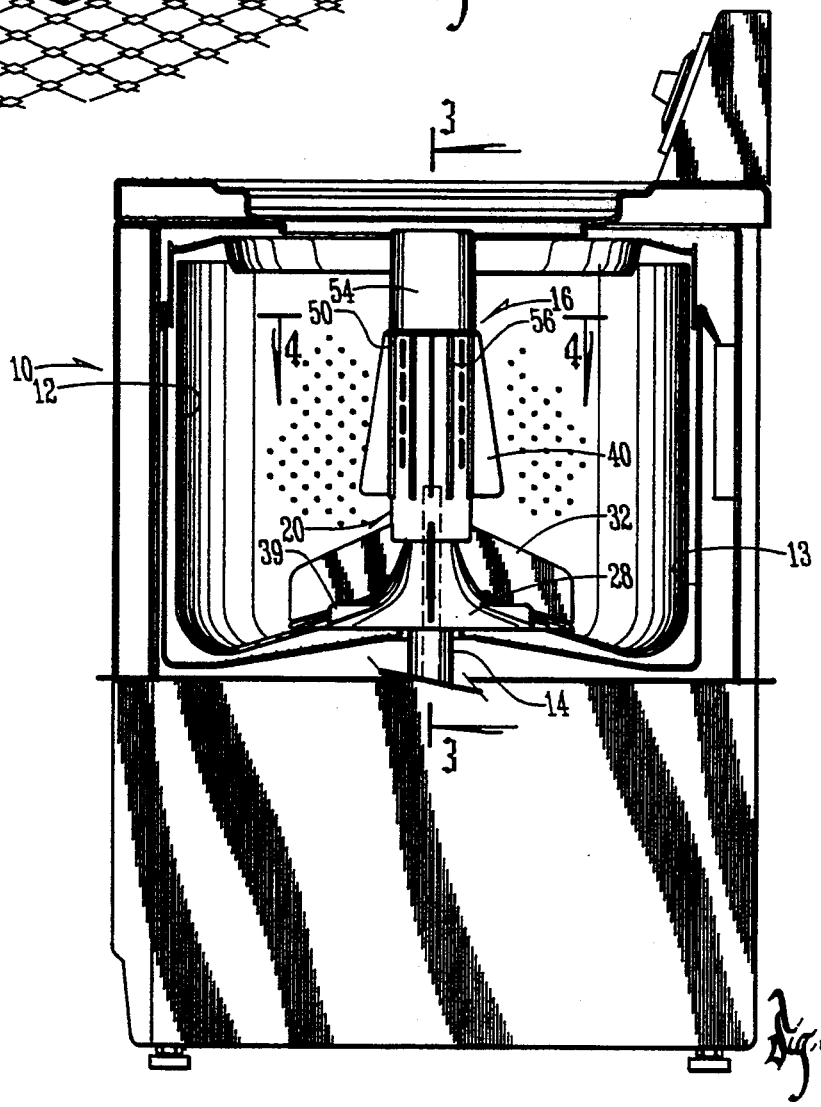
FIG. 2 is a sectional view taken along line 2—2 of FIG. 1.

Referring to the drawings the numeral 10 generally designates a clothes washing machine utilizing the agitator of the present invention. Within washing machine 10 is a perforate clothes basket 12 mounted within an imperforate tub 13. Clothes basket 12 is mounted upon a spindle 14 which can be utilized to rotate the clothes basket 12 during the spin dry cycle of the washing machine.

Centrally located within the basket 12 is an agitator 16. Agitator 16 is mounted upon a splined drive shaft 18 (FIG. 3) which drives the agitator 16 in a reciprocating motion. The length of the rotational stroke of the agitator and the frequency of the strokes may be varied without detracting from the invention. However, the preferred stroke is approximately 97° and the preferred frequency of the strokes is approximately 153 strokes per minutes.

Agitator 16 includes an upstanding barrel or post 20 which includes a hollow cylindrical barrel chamber 22 therein. A plurality of slots or openings 24 are provided in the barrel 20 to provide fluid communication between the interior and exterior of the barrel 20.

The lower end of the agitator 16 is provided with a shaft receptacle 26 which retentively receives the drive shaft 18 so that reciprocating rotation of the drive shaft 18 causes corresponding reciprocating rotational movement of the agitator 16.

The lower end of the agitator 16 is provided with a tapered skirt 28 which commences at the lower end of barrel 20 and tapers outwardly and downwardly therefrom to terminate in an outer edge 29. Adjacent outer edge 29 is an upwardly presented surface 30. Adjacent the upper end of tapered skirt 28 is a truncated portion 31. Attached to the truncated portion 31 and extending radially outwardly therefrom are a plurality of lower vanes 32, each of which includes a base portion 34 which is attached to and integrally formed with the truncated portion 31 of skirt 28. Each vane 32 also includes an outer flexible portion 36 which is detached from the skirt 28 to provide an elongated slot 38 (FIG. 3) therebetween. Attached to skirt 28 and extending upwardly from the upwardly presented surface 30 thereof between the lower vanes 32 are a plurality of smaller partial vanes 39 which are triangular in shape.

Attached to the barrel 20 and extending radially outwardly therefrom are four triangular upper vanes 40 each of which include an inner edge 42, an outer edge 44, a lower edge 46, and an upper edge 48. Immediately above the triangular vanes 40 is a splash ring 50 having a downwardly facing flat horizontal surface 52. The upper edges 48 of the triangular vanes 40 abut against the downwardly facing flat surface 52 of splash ring 50, and are integrally formed therewith. The outer edges 44 of the triangular vanes 40 commence at the splash ring 50 and angle downwardly and outwardly therefrom to the lower edges 46.

A cylindrical dispenser 54 telescopically frictionally fits within the upper end of barrel 20 and is adapted to dispense fabric conditioning fluids or other additives to the interior hollow chamber 22 of barrel 20.

Positioned between each pair of triangular upper vanes 40 are a pair of rectangular ribs 56. These rectangular ribs 56 each include an upper end 58 which abuts with and is integral with the downwardly facing surface 52 of splash ring 50. The rectangular ribs 56 also include lower ends 60 spaced above lower vanes 32 and outer edges 62 which are positioned in approximate registered alignment with the outer circumferential edge of splash ring 50. It should be noted that the lower ends of triangular ribs 40 extend radially outwardly beyond the outer edge of splash ring 50, but the rectangular ribs 56 do not extend radially outwardly beyond the outer edge of the splash ring 50.

Figure 3:
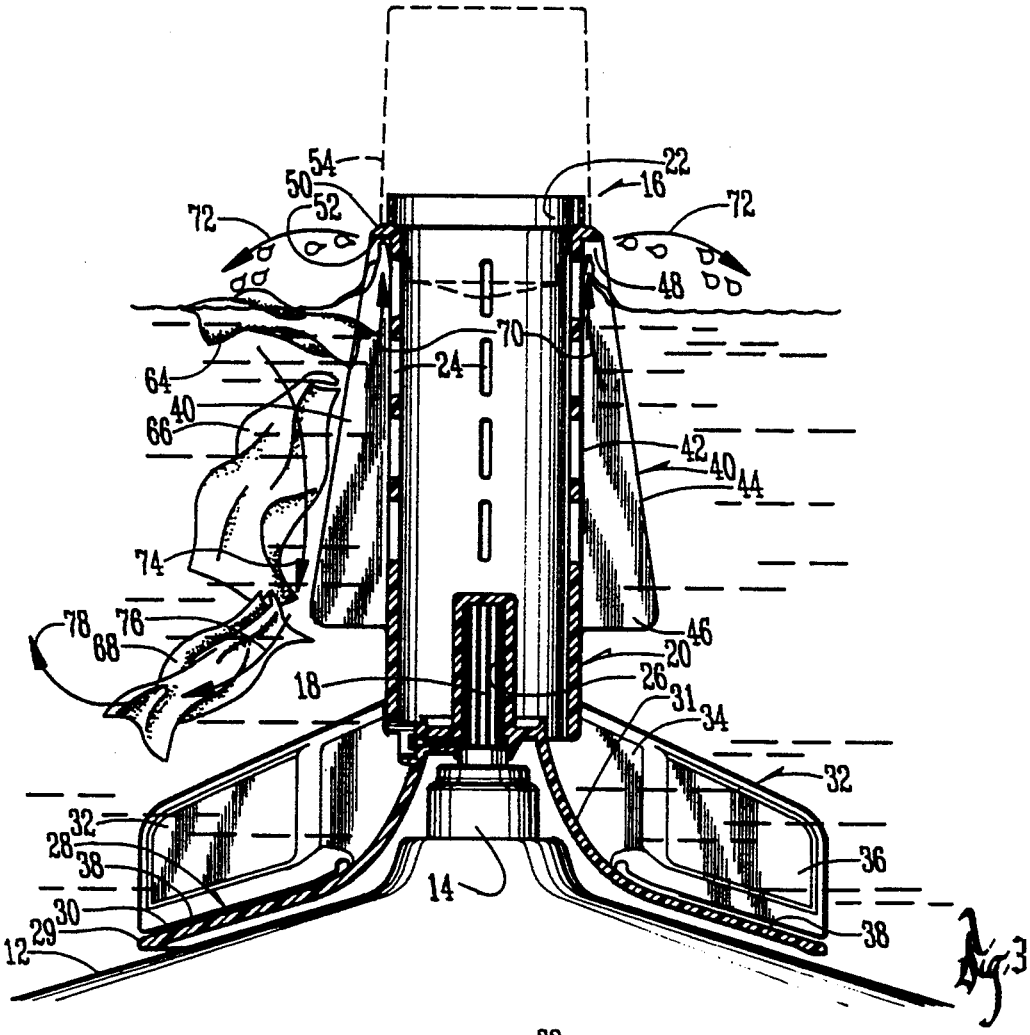
FIG. 3 is a sectional view taken along line 3—3 of FIG. 2.

The agitator 16 of the present invention permits thorough turnover and agitation of clothing when the washing machine 10 is filled to its highest capacity level as shown in FIG. 3. Prior washing machines utilizing the straight edged vanes did not extend completely up to the splash ring 50 as do the triangular vanes 40 and the rectangular ribs 56. The operation of the agitator 16 is illustrated in FIG. 3 which shows a plurality of articles of clothing 64, 66, 68 being washed. When the tub 13 is filled to the level shown in FIG. 3, and when the clothing is inserted into the clothes basket 12, many articles of clothing float on the top as illustrated by article 64 shown in FIG. 3. The reciprocating motion of the agitator 16 causes water to be drawn upwardly along the barrel 20 in the manner indicated by arrow 70 this water travels up the surfaces of the vanes 40 and the rectangular ribs 56, and encounters the downwardly presented surface 52 of splash ring 50. Upon encountering the surface 52 the water splashes radially outwardly in the manner indicated by arrows 72, and falls downwardly on the surface of the clothing article 64 which is floating on the upper surface of the water. This contributes to the wetting of the clothing and causes the clothing to ultimately submerge below the surface of the water. At the same time, the triangular vanes 40 and the rectangular ribs 56 engage portions of the clothing article 64 and begin to grasp the clothing and pull the clothing downwardly along the post or barrel 20 in the manner indicated by arrows 74. The clothing continues down along the post 20 as illustrated by article 66, and then passes along the bottom of the basket 12 to the outer edge thereof and upwardly along the outer edge. This motion is depicted by arrows 76, 78. Thus a continuous toroidal motion of the clothing articles is provided by the reciprocating agitating motion of the agitator 16.

Several advantages are obtained with the agitator of the present invention. The horizontal downwardly presented surface 52 of splash ring 50 contributes greatly to the wetting action of the clothing. In prior devices the lower surface of the splash ring 50 was not perpendicular to the vertical post 20, and did not provide the horizontal redirection of the water as occurs with the agitator of the present invention. The splashing of this water horizontally facilitates the wetting of the clothing articles that are floating on the surface of the water, and also prevents the water from splashing upwardly and out of the clothes basket 12 when the access door 11 is open. The rectangular ribs aid considerably in the carrying of water up to the top of the barrel or post 20.

The fact that the triangular ribs 40 and the rectangular ribs 56 extend upwardly above the surface of the water and completely up to the splash rib 50 facilitates the turnover action of the clothing during the washing cycle. In prior agitators utilizing straight ribs, the ribs did not extend sufficiently high to engage the clothing articles floating on the surface of the water in the manner shown by article 64 in FIG. 3. Another feature of the agitator of the present invention that contributes to the turnover of the clothing is the squared off lower edges 46 of the triangular vanes 40. Experience has shown that the squared off lower edges 46 of these vanes 40 create a more aggressive pulling action on the clothes so as to pull them downwardly for the turnover action. It is believed that the squared off lower edges 46 contribute to a suction action along the outer surface of the post 20 to facilitate this turnover action.

Figure 4:
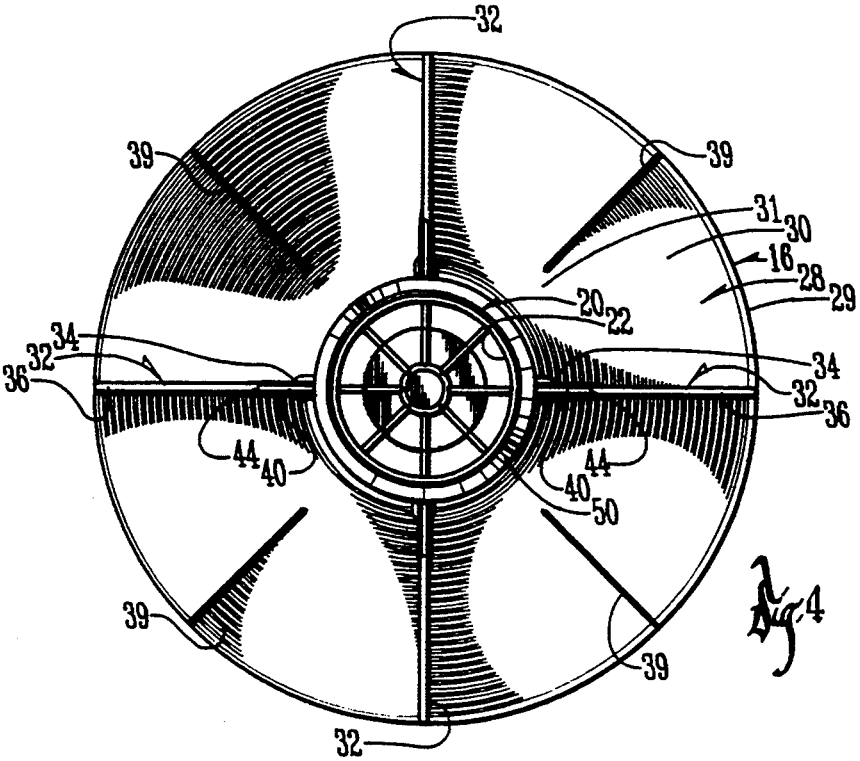
FIG. 4 is a sectional view taken along line 4—4 of FIG. 2.
Figure 5:
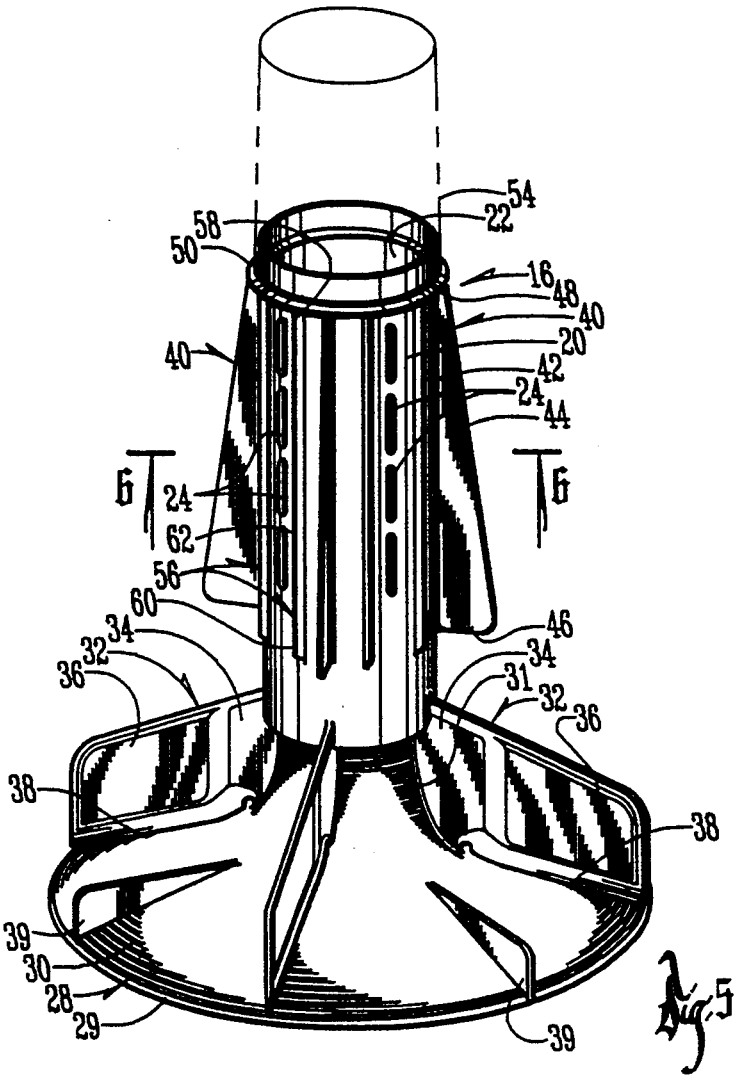
FIG. 5 is a perspective view of the agitator of the present invention.
Figure 6:
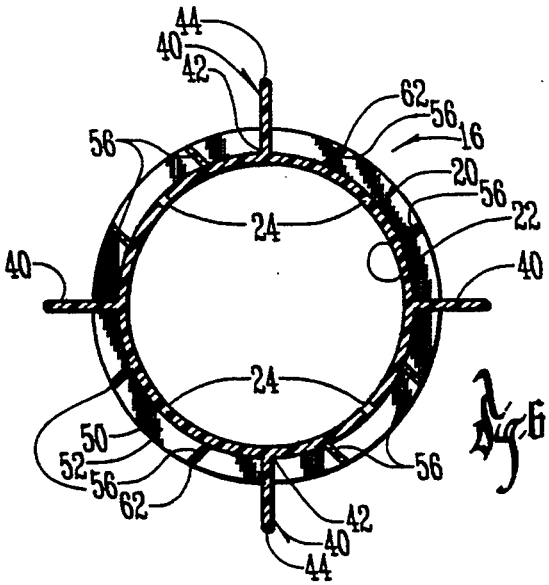
FIG. 6 is a sectional view taken along line 6—6 of FIG. 5.

Referring to FIG. 6 each pair of rectangular ribs 56 is oriented in a parallel relationship. This facilitates the molding of the present invention into a single unitary unit. The mold used is a four part mold, with each mold part forming one of the four quadrants defined by the spaces between the four upper vanes 40 and the four lower vanes 32 (FIG. 4). The fact that the rib pairs 56 are parallel to one another permits each of the four parts of the mold to be pulled radially outwardly away form the agitator after the molding is complete.

The agitator of the present invention is very gentle on clothing compared to the more aggressive action provided by the serpentine ribs used in many prior art agitators. However, the agitator provides better turnover and better washing action than prior straight edge agitators when the machine is filled to its capacity level.

In the drawings and specification there has been set forth a preferred embodiment of the invention, and although specific terms are employed, these are used in a generic and descriptive sense only and not for purposes of limitation. Changes in the form and the proportion of parts as well as in the substitution of equivalents are contemplated as circumstances may suggest or render expedient without departing from the spirit or scope of the invention as further defined in the following claims.

We claim:

1. A washing machine agitator comprising:

a vertical barrel having a top end, a bottom end, and an external barrel surface extending between said top end and said bottom end;

a skirt connected to said bottom end of said barrel and having a generally upwardly facing tapered skirt surface;

a splash rib extending circumferentially around said barrel adjacent said top end thereof and protruding outwardly from said external barrel surface, said splash rib having a substantially horizontal downwardly presented lower surface;

a plurality of lower vanes connected to said barrel, each of said lower vanes having upstanding vane surfaces extending outwardly from said barrel adjacent said tapered skirt surface; and a plurality of upper vanes connected to said barrel, each of said upper vanes extending outwardly from said barrel to terminate in an outer vane edge, said outer vane edge commencing at an upper end adjacent said splash rib and extending downwardly and outwardly therefrom to terminate in a lower end.

2. A washing machine agitator according to claim 1 wherein each of said upper vanes has vertically disposed opposite surfaces and extend radially outward from said barrels.

3. A washing machine agitator according to claim 1 wherein said upper vanes each have a triangular shape, said outer vane edges each forming one side of said triangular shape, said upper vanes having an inner edge forming a second side of said triangular shape, and a bottom edge forming a third side of said triangular shape, said inner edge being connected to said barrel and said bottom edge extending from said external barrel surface to said lower end of said outer vane edge.

4. A washing machine agitator according to claim 3 wherein said bottom edges of said upper vanes are horizontally disposed.

5. A washing machine agitator according to claim 4 wherein said bottom edges of said upper vanes are spaced above said lower vanes.

6. A washing machine agitator according to claim 1 and further including at least one rectangular rib having an inner edge connected to said barrel, an upper edge adjacent said splash rib, a lower edge, and an outer edge spaced radially outwardly from said external barrel surface.

7. A washing machine agitator according to claim 6 comprising at least one pair of said rectangular ribs, said rectangular ribs of said at least one pair lying in separate planes which are parallel to one another.

8. A washing machine agitator according to claim 7 wherein four of said upper vanes are spaced circumferentially from one another around the circumference of said barrel, and four of said pairs of said rectangular ribs are positioned around said barrel, each of said four pairs of rectangular ribs being positioned between two of said upper vanes in alternating fashion.

9. A washing machine agitator according to claim 8 wherein all of said upper edges of said rectangular ribs and all of said upper ends of said outer edges of said upper vanes abut said splash rib.

10. A washing machine agitator comprising:

a vertical barrel having a top end, a bottom end, and an external barrel surface extending between said top end and said bottom end;

a skirt connected to said bottom end of said barrel and having a generally upwardly facing tapered skirt surface which in cross section commences adjacent said bottom end of said barrel and tapers outwardly and downwardly therefrom;

a splash rib extending circumferentially around said barrel adjacent said top end thereof and protruding outwardly from said external barrel surface;

a plurality of lower vanes connected to said barrel, each of said lower vanes having oppositely opposed upstanding vane surfaces extending outwardly from said barrel adjacent said tapered skirt surface;

a plurality of triangular shaped vanes connected to said barrel above said lower vanes, each of said triangular shaped vanes having opposite upstanding surfaces, an inner edge connected to said barrel, and an outer edge positioned outwardly from said external barrel surface; and a plurality of rectangular shaped ribs connected to said barrel above said lower vanes, and extending outwardly from said external barrel surface, each of said rectangular shaped ribs being spaced circumferentially from each of said triangular shaped ribs.

11. A washing machine agitator according to claim 10 wherein said rectangular shaped ribs each include an upper edge abutting said splash rib.

12. A washing machine agitator according to claim 11 wherein each of said triangular shaped vanes includes an upper end abutting said splash ring.

13. A washing machine agitator according to claim 12 wherein each of said triangular shaped vanes include a lower edge spaced above said lower vanes.

14. A washing machine agitator according to claim 11 wherein each of said rectangular shaped ribs include a lower edge spaced above said lower vanes.

15. A washing machine agitator according to claim 13 wherein each of said lower edges of said triangular shaped vanes is horizontally disposed.

16. A washing machine agitator according to claim 14 wherein each of said lower edges of said rectangular shaped ribs is horizontally disposed.

17. A washing machine agitator according to claim 10 wherein said splash ring extends radially outwardly a first distance from said external barrel surface, said rectangular shaped ribs each extend radially outwardly from said external surface a second distance which is no greater than said first distance, and at least a portion of each of said triangular vanes extend radially outwardly from said external surface of said barrel a third distance which is greater than said first distance.

18. A washing machine agitator according to claim 10 wherein each of said triangular shaped vanes and each of said rectangular shaped ribs lie in a vertical plane.

19. A washing machine agitator according to claim 10 wherein said barrel, said lower vanes, said triangular shaped vanes, and said rectangular shaped vanes are formed of unitary molded plastic construction.

20. A washing machine agitator comprising:

a vertical barrel having a top end, a bottom end, and an external barrel surface extending between said top end and said bottom end;

a skirt connected to said bottom end of said barrel and having a generally upwardly facing tapered skirt surface;

a splash rib extending circumferentially around said barrel adjacent said top end thereof and protruding outwardly from said external barrel surface;

a plurality of lower vanes connected to said barrel, each of said lower vanes having upstanding vane surfaces extending outwardly from said barrel adjacent said tapered skirt surface; and a plurality of triangular shaped vanes connected to said barrel, each of said triangular shaped vanes extending outwardly from said barrel to terminate in an outer inclined vane edge, said outer inclined vane edge commencing at an upper end adjacent said splash rib and extending downwardly and outwardly therefrom to terminate in a lower end.

21. A washing machine agitator according to claim 1 wherein each of said upper ends of said outer vane edges of said triangular shaped vanes abut against said splash rib.

22. A washing machine agitator comprising:

a vertical barrel having a top end, a bottom end, and an external barrel surface extending between said top end and said bottom end;

a skirt connected to said bottom end of said barrel and having a generally upwardly facing tapered skirt surface;

a splash rib extending circumferentially around said barrel adjacent said top end thereof and protruding outwardly from said external barrel surface;

a plurality of lower vanes connected to said barrel, each of said lower vanes having oppositely opposed upstanding vane surfaces extending outwardly from said barrel adjacent said tapered skirt surface;

a plurality of triangular shaped vanes connected to said barrel above said lower vanes, each of said triangular shaped vanes having opposite upstanding surfaces, an upper end abutting said splash rib, an inner edge connected to said barrel, and an outer edge positioned outwardly from said external barrel surface; and a plurality of rectangular shaped ribs connected to said barrel above said lower vanes, and extending outwardly from said external barrel surface.

23. A washing machine agitator according to claim 22 wherein said rectangular shaped ribs each include an upper end abutting said splash rib.

* * * * *